United States Patent [19]

Watanabe et al.

[11] Patent Number: 4,489,552

[45] Date of Patent: Dec. 25, 1984

[54] AUTOMATIC NEUTRAL POINT DETECTING SYSTEM FOR HYDRAULIC PUMP

[75] Inventors: Hiroshi Watanabe; Eiki Izumi, both of Ibaraki, Japan

[73] Assignee: Hitachi Construction Machinery Co., Ltd., Tokyo, Japan

[21] Appl. No.: 538,786

[22] Filed: Oct. 4, 1983

[30] Foreign Application Priority Data

Oct. 5, 1982 [JP] Japan ..... 57/173857
Sep. 20, 1983 [JP] Japan ..... 58/173995

[51] Int. Cl.[3] ..... F15B 21/02

[52] U.S. Cl. ..... 60/389; 60/390; 60/442; 417/217

[58] Field of Search ..... 417/217, 218, 222, 219, 417/220, 221; 60/368, 445, 452, 389, 390, 492

[56] References Cited

U.S. PATENT DOCUMENTS 4.151,718 5/1979 Gravely ..... 60/368 X
4,369,625 1/1983 Izumi et al. ..... 60/368 X
4,399,653 8/1983 Pylat ..... 60/368 X
4,412,500 11/1983 Krautkremer ..... 60/390 X

*Primary Examiner*—Edward K. Look
*Attorney, Agent, or Firm*—Antonelli, Terry & Wands

[57] ABSTRACT

An automatic neutral point detecting system for a hydraulic pump equipped with a displacement varying device capable of shifting both in a (+) direction and in a (−) direction and connected to at least one hydraulic actuator to form a hydraulic circuit to drive the hydraulic actuator. The system includes pressure sensors for sensing the port pressures of the hydraulic pump, a shifting detector for detecting the shifting of the displacement varying device, a closing device for closing the hydraulic circuit and blocking the flow of a hydraulic fluid, a start switch for giving a command to start detection of the neutral point of the hydraulic pump, and a control unit for detecting the neutral point of the hydraulic pump. The control unit includes means responsive to the command given by the start switch for giving a command to activate the closing device, data collecting means for causing the displacement varying device to shift at least once in the (+) direction and in the (−) direction based on information from the pressure sensors and the shifting detector until the port pressure on the discharge side of the hydraulic pump becomes at least substantially equal to the same predetermined pressure set beforehand for each shifting direction and collecting data on the values of the shifting of the displacement varying device when the port pressure on the discharge side of the hydraulic pump becomes substantially equal to the predetermined pressure, and means for producing a mean of the values collected by the data collecting means.

10 Claims, 11 Drawing Figures

AUTOMATIC NEUTRAL POINT DETECTING SYSTEM FOR HYDRAULIC PUMP

BACKGROUND OF THE INVENTION

This invention relates to automatic neutral point detecting systems for a hydraulic pump adapted to drive at least one hydraulic actuator, and, more particularly, it is concerned with an automatic neutral point detecting system for a hydraulic pump equipped with a displacement varying device capable of shifting both in a (+) direction and in a (−) direction, the displacement varying device being automatically operated to regulate the delivery of the pump, to thereby effect control of the operation of the hydraulic actuator.

Proposals have in recent years been made to equip hydraulic pumps used in various types of hydraulic machines and hydraulic apparatus with a displacement varying device which is capable of shifting both in a (+) direction and in a (−) direction and to control such displacement varying device electrically to regulate the delivery of the pump, in order to conserve energy and improve the performance. In this control system, displacement or shifting of the displacement varying device of a hydraulic pump is automatically detected and a signal is produced for regulating the delivery of the hydraulic pump. In this case, it is essential that the neutral point of the hydraulic pump and the signal produced by a device for detecting the shifting of the displacement varying device exactly match. To this end, it has hitherto been usual practice to provide a control system for a hydraulic pump with a zero point compensating circuit for detecting the neutral point of the hydraulic pump and compensating the signal produced by the shifting detecting device.

More specifically, a hydraulic pump provided with a displacement varying device capable of shifting both in a (+) direction and in a (−) direction is connected to at least one hydraulic actuator and forms a hydraulic circuit for driving the hydraulic actuator. The displacement varying device may comprise a swash plate or a bent axis depending on the type of the hydraulic pump. In the description to be set forth hereinafter, the displacement varying device will be described as comprising a swash plate. In this type of hydraulic circuit, the swash plate is driven for operation by a regulator in accordance with an electric signal inputted to the control system. Associated with the swash plate is a shifting detector for detecting the tilting of the swash plate which comprises a potentiometer and the like. The shifting detector is mechanically connected to the swash plate and produces a signal indicative of the shifting of the swash plate. The shifting detector is electrically connected to a zero point compensating circuit for compensating the zero point which comprises a variable resistor and an adding circuit. The principle of the zero point compensation and the structure of the zero point compensating circuit are described later. An operation lever for operating the actuator produces a signal indicative of a manipulated variable. A signal produced by the zero point compensating circuit and the signal produced by the operation lever are supplied to the control system which generates a control signal for effecting control to bring the shifting of the swash plate into agreement with the shifting commanded by the operation lever.

The principle of the zero point compensation and the structure of the zero point compensating circuit will be described in detail. In order for the shifting detector to produce a correct signal indicative of the shifting of the swash plate, the neutral point of the hydraulic pump or the neutral point of the swash plate should coincide with a neutral point signal produced by the shifting detector when the swash plate is in the neutral position, or a signal OV, for example. However, since the swash plate is mechanically connect to the shifting detector, difficulties are experienced in connecting them together in such a manner that a perfect agreement can be reached between the neutral point of the swash plate and the signal (OV) produced by the shifting detector as corresponding to the neutral position of the swash plate. If there is a difference between the neutral point of the swash plate and the signal produced by the shifting detector, then the shifting detector would produce a signal indicating that the swash plate is located in the neutral position in spite of it not being located in the neutral position, and cause the control system to effect control on the premise that the swash plate is located in the neutral position. As a result, the swash plate would not actually be located in the neutral position in spite of the fact that the operation lever is operated to bring the swash plate to the neutral position or it commands the hydraulic pump to reduce its delivery to zero, so that hydraulic fluid would be discharged through one of a pair of ports of the hydraulic pump. When this occurs, the hydraulic fluid thus delivered by the hydraulic pump would flow through a relief valve to a reservoir, thereby wasting the energy of the hydraulic fluid. Moreover, even if the operation lever is manipulated to command the hydraulic pump to deliver the hydraulic fluid in the same volume for both of the pair of ports of the pump, the actual deliveries at the ports would have different valves. Also, even if an attempt is made to move the actuator in one direction, the situation might arise in which the actuator would move in the opposite direction for an instant before moving in the correct direction, thereby adversely affecting the operation of the actuator.

To obviate these problems, it has hitherto been usual practice to provide the control system with a zero point compensating circuit to compensate for any discrepancy that might exist between the neutral point of the swash plate and the signal produced by the shifting detector. More specifically, the zero point compensating circuit operates such that when there is a difference between a signal that should be produced by the shifting detector when the swash plate is in the neutral position and the signal actually produced by the shifting detector, a variable resistor produces a signal indicative of the difference, and the signal is added to the output signal of the shifting detector by the adding circuit to compensate the output signal of the shifting detector. Thus, the neutral position of the swash plate and the signal inputted to the control system can be brought into agreement with each other, thereby obviating the aforesaid disadvantages of the prior art.

The compensation to be commanded by the variable resistor of the zero point compensating circuit is set as follows. The hydraulic pump is driven by a prime mover while the operation lever is brought to a neutral position. The variable resistor is adjusted in such a manner that the hydraulic fluid discharged through the two ports of the hydraulic pump becomes zero in volume or the swash plate shifts to a neutral position while the operation lever is in the neutral position as aforesaid.

The value of the variable resistor reached at this time is one which should be used for effecting compensation.

Some disadvantages are associated with the use of the zero point compensating circuit of the prior art. First, it is troublesome to manually effect adjustments of the variable resistor. The trouble increases in proportion to an increase in the number of hydraulic pumps. It would be apparent that it would not be desirable for adjustment of the variable resistor to be handled in the process of production of the hydraulic pumps before they are shipped to the users. Moreover, even if it is assumed that the variable resistors are correctly adjusted before being sold to the users, there would occur drift in the zero point compensating circuit due to changes in temperature, and disagreement due to changes in the connection between the swash plate and the shifting detector with time. The operation which should be performed to remedy them is time-consuming and labor-wasting because constant inspection and asjustment are required.

SUMMARY OF THE INVENTION

This invention has been developed for the purpose of obviating the aforesaid disadvantages of the prior art. Accordingly, the invention has as its object the provision of an automatic neutral point detecting system for a hydraulic pump capable of effecting automatic detection of the hydraulic pump in the neutral point to thereby enable control of the hydraulic pump to be accurately effected.

To accomplish the aforesaid object, the invention provides an automatic neutral point detecting system for a hydraulic pump equipped with displacement varying means capable of shifting both in a (+) direction and in a (−) direction and connected to at least one hydraulic actuator to form a hydraulic circuit for driving the hydraulic actuator, comprising (a) means for sensing the port pressures of the hydraulic pump; (b) means for detecting the shifting of the displacement varying means; (c) means for closing the hydraulic circuit to block the flow of a hydraulic fluid; (d) start means for giving a command to start detection of the neutral point of the hydraulic pump; and (e) control means for performing detection of the neutral point of the hydraulic pump; (f) the control means including (i) means responsive to the command given by the start means for giving a command to activate the closing means; (ii) data collecting means for causing the displacement varying means to shift at least once in the (+) direction and in the (−) direction based on information from the pressure sensing means and the shifting detecting means until the port pressure of the hydraulic pump on the discharge side thereof sensed by the pressure sensing means becomes at least substantially equal to the same predetermined pressure set beforehand for each shifting direction and collecting data on the value of the shifting of the displacement varying means obtained when the port pressure on the discharge side of the hydraulic pump becomes substantially equal to the predetermined value; and (iii) means for obtaining a means of the values collected by the data collecting means.

DESCRIPTION OF THE PREFERRED EMBODIMENTS

Figure 1:
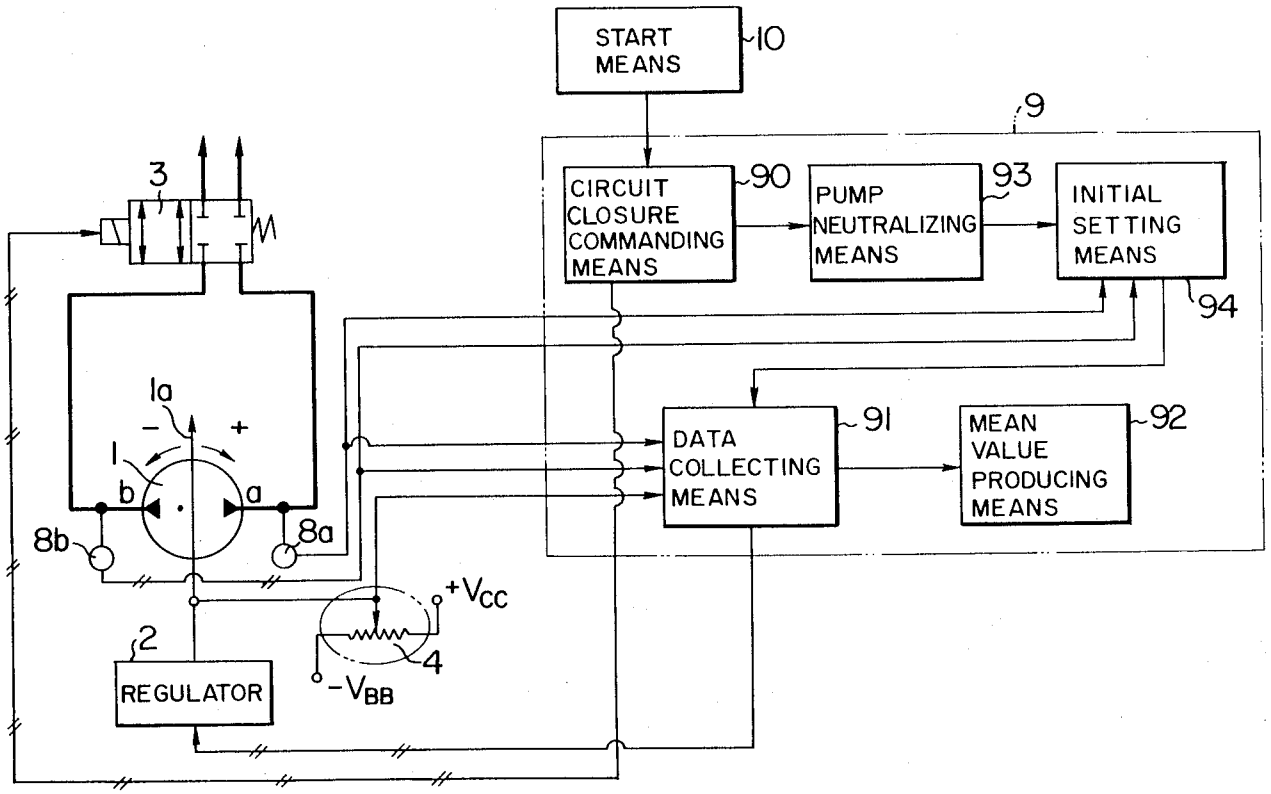
FIG. 1 is a block diagram showing the basic construction of the automatic neutral point detecting system for a hydraulic pump according to the invention.

Referring to FIG. 1, the reference numeral 1 designates a hydraulic pump equipped with a displacement varying device 1*a* capable of shifting both in a (+) direction and in a (−) direction. In the embodiment shown, the displacement varying device 1*a* comprises a swash plate which has its shifting or tilting regulated by a regulator 2 which becomes operative upon receipt of an electric signal. The hydraulic pump is connected to a hydraulic actuator, not shown, and forms a hydraulic circuit to drive the hydraulic actuator.

Connected between the hydraulic pump 1 and the hydraulic actuator is an on-off control valve 3 movable between an open position and a closed position upon receipt of an electric signal. The on-off control valve 3 constitutes means for closing the hydraulic circuit to block the flow of a hydraulic fluid therethrough.

The swash plate 1*a* is operatively associated with a shifting detector 4 for detecting its tilting which comprises a potentiometer. The shifting detector 4 is mechanically connected to the swash plate 1*a* and produces a signal Y indicative of the tilting of the swash plate 1*a*. Pressure sensors 8*a* and 8*b* are connected to ports a and b, respectively, of the hydraulic pump 1 and produce signals Pa and Pb indicative of the pressures in the ports a and b respectively. A reference numeral 9 generally designates a control unit constituting an essential part of the automatic neutral point detecting system for the hydraulic pump 1. The control unit 9 is responsive to a command given by start means 10 to perform detection of the neutral point of the hydraulic pump 1.

In its basic construction, the control unit 9 comprises (i) means 90 responsive to a command given by the start means 10 to give a command to activate the valve 3, (ii) data collecting means 91 for causing the swash plate 1*a* to shift at least once in a (+) direction and in a (−) direction based on information from the pressure sensors 8*a* and 8B and the shifting detector 4 until the port pressure on the discharge side of the hydraulic pump 1 becomes at least substantially equal to the same predetermined value set beforehand for each shifting direction, and collecting data on the values of the tilting of the swash plate 1*a* obtained when the port pressure on the discharge side of the hydraulic pump 1 becomes substantially equal to the predetermined pressure, and (iii) means 92 for obtaining a mean of the value collected by the data collecting mean 91.

Preferably, the control unit 9 further includes (iv) means 93 responsive to the command given by the start means 10 for causing the swash plate 1*a* to shift to an instantaneous neutral position before the data collecting means 91 and the mean value producing means 92 start their operation.

Preferably, the control unit 9 further includes (v) initial setting means 94 for deciding, based on information from the pressure sensors 8*a* and 8*b*, the direction in which the swash plate 1*a* first shifts in accordance with the operation of the data collecting means before the data collecting means 91 and mean producing means 92 start their operation.

Figure 2:
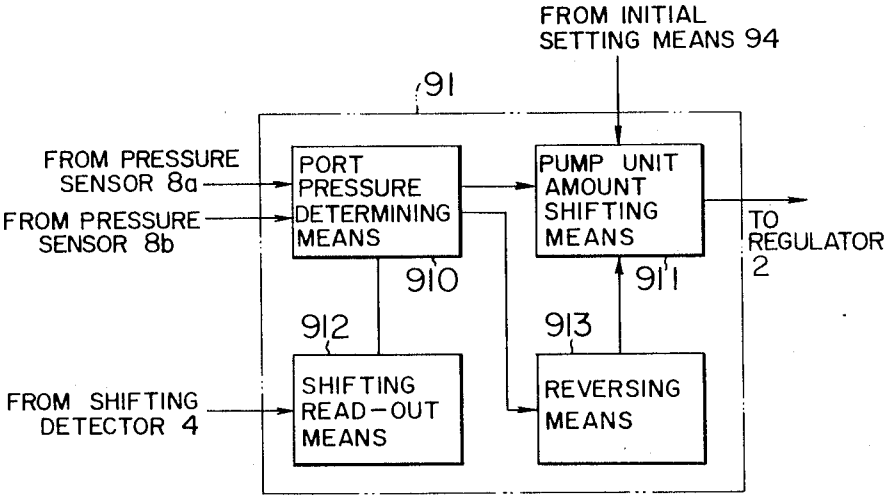
FIG. 2 is a block diagram showing one form of the data collecting means of the control unit shown in FIG. 1.

As shown in FIG. 2, the data collecting means 91 preferably includes means 910 for determining whether or not the port pressure on the discharge side of the hydraulic pump 1 is higher than the predetermined value set beforehand, means 911 for causing the swash plate 1*a* to shift by a predetermined unit amount when the port pressure is not higher than the predetermined value set beforehand, and means for reading the shifting of the swash plate 1*a* when the port pressure becomes substantially equal to the predetermined value set beforehand.

Preferably, the data collecting means further includes means for reversing the direction in which the swash plate 1*a* shifts after the swash plate 1*a* first shifts in the direction as decided by the initial setting means 94 and data on the shifting thereof in said direction has been collected.

Figure 3:
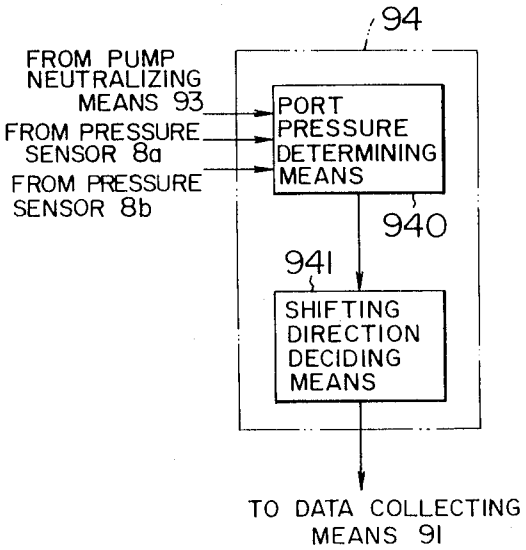
FIG. 3 is a block diagram showing one form of the initial setting means of the control unit shown in FIG. 1.

As shown in FIG. 3, the initial setting means 94 preferably includes means 940 for determining whether or not port pressure of one of the pair of ports of the hydraulic pump 1 is higher than the predetermined value when the swash plate 1*a* is in the instantaneous neutral position, and means 941 for bringing the initial shifting direction into agreement with a direction in which the port pressure rises when the port pressure is not higher than the predetermined pressure and bringing the initial shifting direction into agreement with a direction in which the pump pressure drops when the port pressure is higher than the predetermined pressure.

Figure 4:
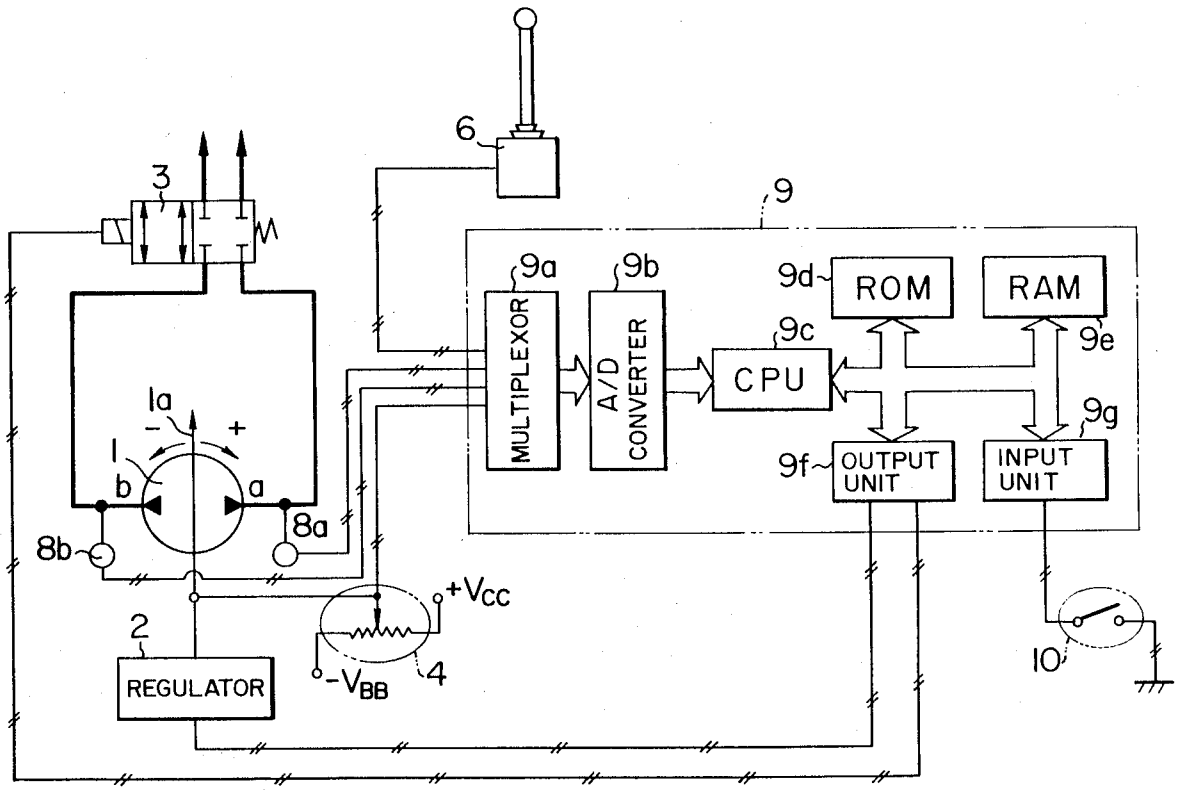
FIG. 4 is a block diagram of the automatic neutral point detecting system for a hydraulic pump comprising one embodiment of the invention.

As shown in FIG. 4, the control unit 9 can be formed by using a microcomputer in one embodiment of the invention. In this embodiment, an operation lever 6 for operating the hydraulic actuator is connected to the control unit 9 and produces a signal X indicative of its manipulated variable. The start means 10 comprise a start switch which is closed when a command is given to initiate detection of the neutral point of the hydraulic pump 1.

The control unit 9 comprises a multiplexor 9*a*, and A/D converter 9*b*, a central processing unit (hereinafter CPU) 9*c*, a read-only memory (hereinafter ROM) 9*d*, a random access memory (hereinafter RAM) 9*e*, and output unit 9*f* and an input unit 9*g*. The multiplexor 9*a* has inputted thereto a signal Y produced by the shifting detecter 4, the signal X produced by the operation lever 6 and signals Pa and Pb produced by the pressure sensors 8*a* and 8*b*, respectively, which are switched by the control signal produced by the CPU 9*c*. The A/D converter 9*b* converts the analog signals X, Y, Pa and Pb to digital signals. The ROM 9*d* is a memory for storing the processes performed by the control unit 9, and the CPU 9*c* performs necessary arithmetic and logical operations in accordance with these processes. The RAM 9*e* is a memory for temporarily storing the signals X, Y, Pa and Pb supplied from outside and the results of the operations performed by the CPU 9*c*. The output unit 9*f* supplies to the regulator 2 and valve 3 control signals produced as the results of the arithmetic and logical operation performed by the CPU 9*c*. The input unit 9*g* has inputted thereto the condition of the switch 10 whether it is ON or OFF.

Figure 5:
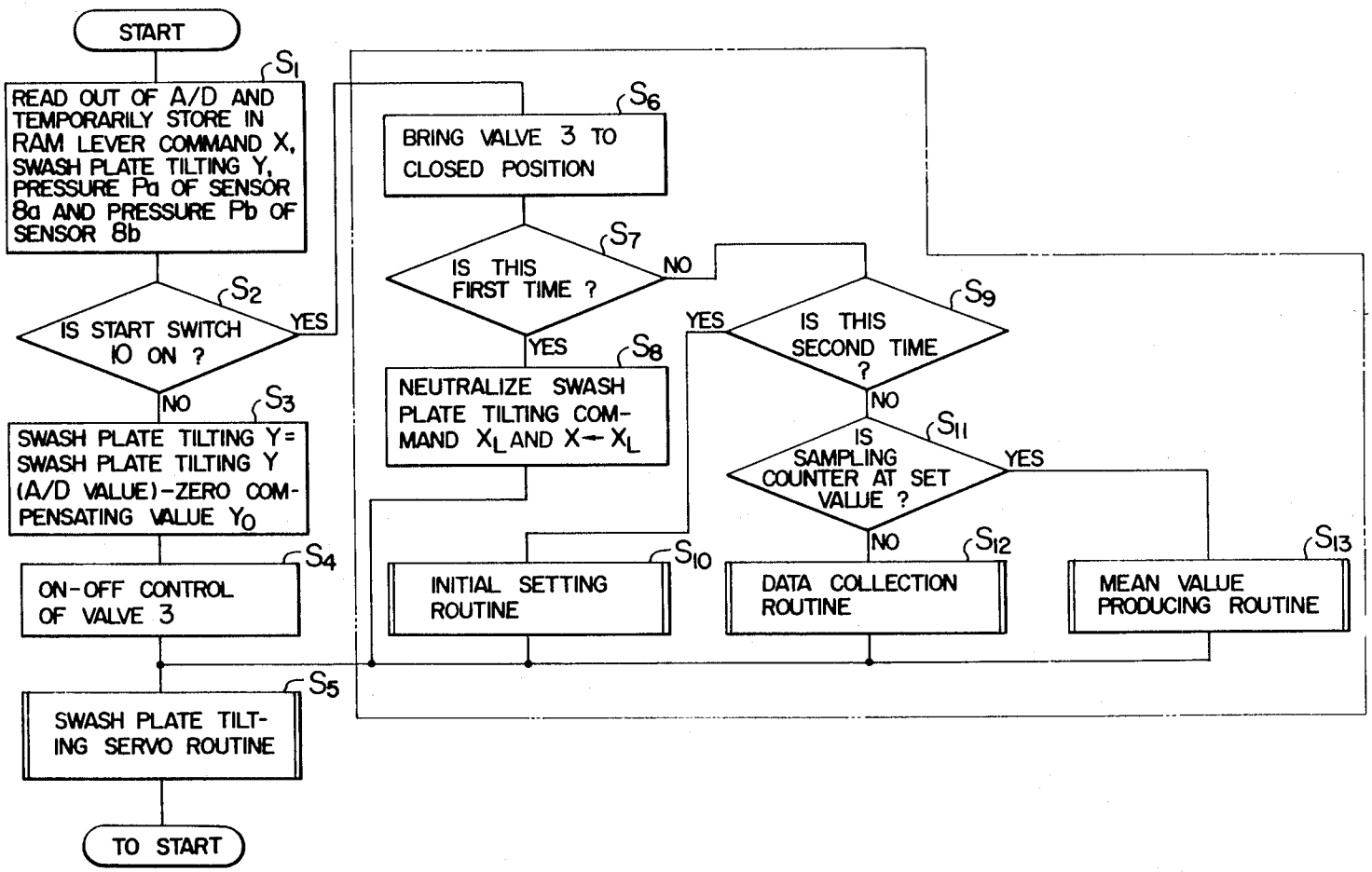
FIG. 5 is a flow chart in explanation of the processes performed by the control unit shown in FIG. 4 in accordance with the program stored in the read-only memory.

The processes performed by the control unit 9 which are stored in the ROM 9*d* will be described by referring to the flow charts shown in FIGS. 5–9. In the flow charts, $S_1$, $S_2$ . . . designate steps. In FIG. 5, the steps shown in the block bounded by dash-and-dot lines are for processes for automatic detection of the neutral point, and the steps shown outside the dash-and-dotlines are for processes usually performed for controlling the swash plate 1*a*. The processes usually performed for controlling the swash plate 1*a* will be first described.

When a switch connecting the system to a power source is turned on, the CPU 9*c* activates the multiplexor 9*a* and A/D converter 9*b* in accordance with the processes stored in the ROM 9*d* and stores in the RAM 9*e* a lever command value X which is a signal produced by the operation lever 6, a swash plate tilting value Y which is a signal produced by the shifting detector 4 and pressure Pa and Pb which are signals produced by the pressure sensors 8*a* and 8*b* ($S_1$). Then, the CPU 9*c* reads the condition of the switch 10 through the input unit 9*g* and determines whether the switch is ON or OFF ($S_2$). When the switch 10 is OFF (or when no command to initiate automatic neutral point detection has been given), the CPU 9*c* retrieves a zero compensating value $Y_0$ which is produced by calculation previously done in automatic neutral point detection subsequently to be described and stored, and deducts the zero compensating value $Y_0$ from the swash plate tilting value Y and produces a compensated swash plate tilting value Y ($S_3$). Thereafter, on-off control of the valve 3 is effected ($S_4$) and the step proceeds to a swash plate tilting servo routine ($S_5$) in which the tilting of the swash plate 1*a* is controlled to a value commanded by the operation lever 6.

Figure 6:
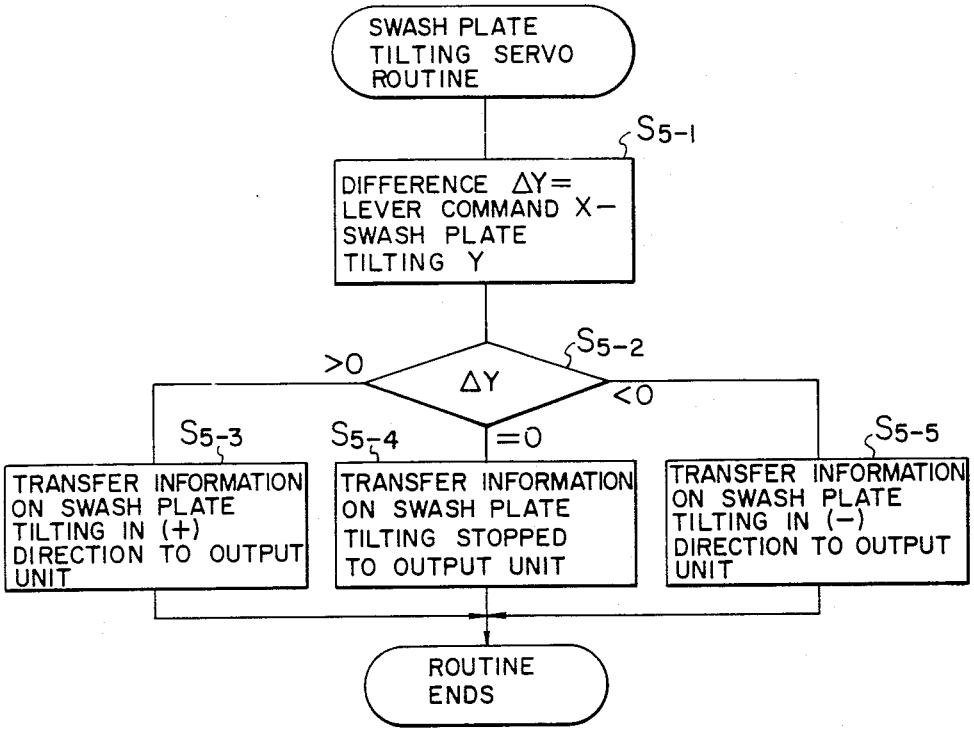
FIGS. 6, 7, 8 and 9 are flow charts showing the processes performed as a swash plate tilting servo routine, an initial setting routine, a data collecting routine and a mean value producing routine, respectively.

FIG. 6 shows in detail the processes performed in the swash plate tilting servo routine. More specifically, the new swash plate tilting value Y produced by calculation in step $S_3$ is deducted from the lever command value X to produce a differential $\Delta Y$ by calculation ($S_{5\text{-}1}$). Then, it is determined whether the differential $\Delta Y$ is positive, negative or zero ($S_{5\text{-}2}$). When the differential $\Delta Y$ is positive, a signal for moving the swash plate 1*a* in a (+) direction shown in FIG. 4 is supplied to the regulator 2 ($S_{5\text{-}3}$); when the differential $\Delta Y$ is negative, a signal for moving the swash plate 1*a* in a (−) direction is supplied to the regulator 2 ($S_{5\text{-}5}$); and when the differential $\Delta Y$ is zero, a signal for stopping the swash plate 1*a* is supplied to the regulator 2 ($S_{5\text{-}4}$). After the processes of the step $S_5$ are performed, the step $S_1$ is followed again and the steps $S_1$-$S_5$ are repeatedly followed to control the movement of the swash plate 1*a*.

Automatic neutral position detecting processes are performed when the start switch 10 is turned on to effect detection of the neutral point of the hydraulic pump 1. More specifically, upon the start switch 10 being turned on, the processes shown in FIG. 5 shift from step $S_2$ to step $S_6$ and et seq. which are automatic neutral point detection processes bounded by the dash-and-dot lines. Before describing the automatic neutral point detection processes, let us outline the processes.

First of all, the hydraulic pump 1 is driven by a prime mover and the on-off control valve 3 is closed to bring the hydraulic circuit to a closed condition. Then, the swash plate 1*a* is moved in the (+) direction and the (−) direction until a pressure of a value set beforehand is produced. Even if the on-off control valve 3 is closed, the hydraulic fluid may leak in minute volumes from the high pressure side to the low pressure side between the ports a and b and the reservoir. Thus, there is a range in which no pressure is produced even if the swash plate 1*a* is moved slightly. Thus, the movement of the swash plate 1*a* described hereinabove would exceed the aforesaid range. Whether or not the pressure of the value set beforehand has been produced can be determined from the signals Pa and Pb produced by the pressure sensors 8*a* and 8*b*, respectively. If the pressure of the value set beforehand has been produced, then sampling is performed on the signal Y produced by the shifting detector 4 in accordance with the tilting of the swash plate 1*a*. Sampling is performed each time the swash plate 1*a* moves in the (+) direction or in the (−) direction. The swash plate 1*a* may be moved in reciprocatory movement several times, and the values obtained by sampling are totalled finally and their mean is obtained by calculation. The mean value obtained in this process is the value of a signal produced by the shifting detector 4 which corresponds to the actual neutral point of the swash plate 1*a*. The difference between the value of this signal and the value of a signal produced by the shifting detector 4 which indicates the instantaneous neutral position of the swash plate 1*a* (or the value of a signal which would be produced by the shifting detector 4 when the swash plate 1*a* is in the neutral position) represents a displacement between the swash plate 1*a* and the shifting detector 4.

The processes outlined hereinabove will be described in detail. If the start switch 10 is closed in step $S_2$ shown in FIG. 5, then step $S_6$ is followed and the automatic neutral point detection processes are performed. First of all, the on-off control valve 3 is closed to close the hydraulic circuit and block the flow of hydraulic fluid therethrough ($S_6$). Then, whether or not the automatic neutral point detection routine is followed for the first time is determined ($S_7$). To this end, a value 0 is stored in one of addresses in the RAM 9*e* when the start switch 10 is closed and the value is changed to 1 when the process shifts from step $S_7$ to step $S_8$, and whether the value in the address is 0 or 1 is determined in step $S_7$. In this case, the automatic neutral point detection routine is followed for the first time, so that the process shifts to step $S_8$. In step $S_8$, a swash plate tilting command $X_L$ which is a command to move the swash plate 1*a* is neutralized. This command is the same command given when the operation lever 6 is brought to a neutral position. However, in this process, a command is given to neutralize the swash plate tilting command $X_L$ without regard to the operation lever 6. This substitutes the swash plate tilting command $X_L$ for the lever command value X. Then, the process shifts to step $S_5$ which is a swash plate tilting servo routine in which processes shown in FIG. 6 are performed. As a result, the swash plate 1*a* is controlled to a tilting value corresponding to the neutral point of the shifting detector 4, and when there is a disagreement between the swash plate 1*a* and the neutral point of the shifting detector 4, the swash plate 1*a* is in a position in which it tilts either in the (+) direction or in the (−) direction. The process returns to step $S_1$ and steps $S_2$ and $S_6$ are followed before the process shifts to step $S_7$. In step $S_7$, a check on the address as described hereinabove shows that the automatic neutral point detection routine is followed for the second time, so that the process shifts to step $S_9$. In step $S_9$, it is determined that the process is performed for the second time and the process shifts to step $S_{10}$. At this time, the value stored in the address as aforesaid is added with 1.

Figure 7:
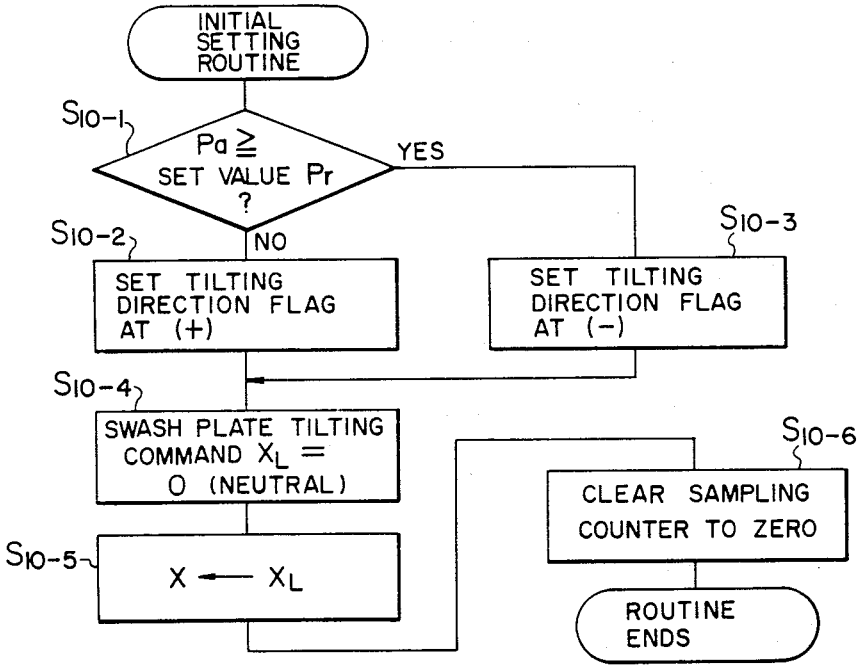

Step $S_{10}$ is an initial setting routine, and the processes performed in this routine are shown in FIG. 7. As described hereinabove, when there is a disagreement between the swash plate 1*a* and the neutral point of the shifting detector 4, the swash plate 1*a* tilts in either direction from the neutral position. When the tilting is great (or when the disagreement is of a large magnitude), the tilting might be such that a pressure equal to or higher than the pressure of the value set beforehand is being produced. In the automatic neutral point detection routine now being described, the processes performed include processes in which the swash plate 1*a* is successively moved in the (+) direction and in the (−) direction, and sampling is performed of the signal Y produced by the shifting detector 4 in a first of all the processes performed for moving the swash plate 1*a* in which the pressure of the value set beforehand is produced. Therefore, if tilting of the swash plate 1*a* is such that the swash plate 1*a* allows a pressure of a value higher than the value set beforehand to be produced, then it is meaningless to further tilt the swash plate 1*a* in the same direction. The initial setting routine of step $S_{10}$ is a routine for determining in which direction the swash plate 1*a* should be moved to eliminate the meaningless tilting movement. Thus, in the initial setting routine, whether or not the value of the signal Pa of the pressure sensor 8*a* received in step $S_1$ is greater than the pressure of the value set beforehand or the pressure $P_r$ ($S_{10\text{-}1}$). When the tilting of the swash plate 1*a* is such that the pressure $P_r$ is not produced yet, it is effective to move the swash plate 1*a* in the (+) direction, so that a tilting direction flag is set at (+) ($S_{10\text{-}2}$). When the signal Pa of the pressure sensor 8*a* exceeds the pressure $P_r$, it is meaningless to further tilt the swash plate 1*a* in the (+) direction as described hereinabove, so that a tilting flag is set at (−)($S_{10\text{-}3}$). This decides the initial tilting direction of the swash plate 1*a* in the data collection routine subsequently to be described. Then, a command is given to neutralize the pump tilting command $X_L$ ($S_{10\text{-}4}$), and the pump tilting command $X_L$ is substituted for the lever command value X ($S_{10\text{-}5}$). This enables the swash plate 1*a* to remain in the tilting position which it now occupies when the process shifts to the swash plate tilting servo routine ($S_5$) through the next following step $S_{10\text{-}6}$. In step $S_{10\text{-}6}$, an operation is performed to clear the sampling counter to take a zero. As described hereinabove, the swash plate 1*a* is moved in reciprocatory movement several times in the (+) and (−) directions, and the values of the signal Y produced by the shifting detector 4 are collected whenever the pressure $P_r$ set beforehand is reached while the swash plate 1*a* is tilted. The number of times the values are collected is predetermined, and sampling is terminated when the predetermined number is reached. This makes it necessary to count the number of times the values are collected. The sampling counter is used for this purpose and set at zero beforehand in step $S_{10\text{-}6}$ for preparation to collect the values of the signal Y to be performed in the following process. When the process of step $S_{10-6}$ is finished, the process is returned to step $S_1$ through step $S_5$. Then, the processes are performed again by starting at step $S_1$ and reach step $S_9$ through steps $S_2$, $S_6$ and $S_7$ (see FIG. 5). When the value stored in the address as described hereinabove is checked, it shows that the processes are performed for the third time. Thus, by determining that the processes are followed not for the second time but for the third time, the processes shift to the next step $S_{11}$. In step $S_{11}$, it is determined whether or not the value indicated by the sampling counter coincides with the value set beforehand. In this case, however, the value indicated by the sampling counter is zero because the values of the signal Y are not collected yet, so that the process shifts to step $S_{12}$.

Step $S_{12}$ is a data collection routine. Until the process shifts to step $S_{12}$, the swash plate 1*a* is held in a state of tilting corresponding to a signal for neutralizing the swash plate tilting command $X_L$. It is not until the process shifts to the data collection routine that the swash plate 1*a* tilts in the (+) direction or in the (−) direction to allow data (values of the signal Y produced by the shifting detector 4 when the pressure $P_r$ set beforehand is produced) to be collected.

Figure 8:
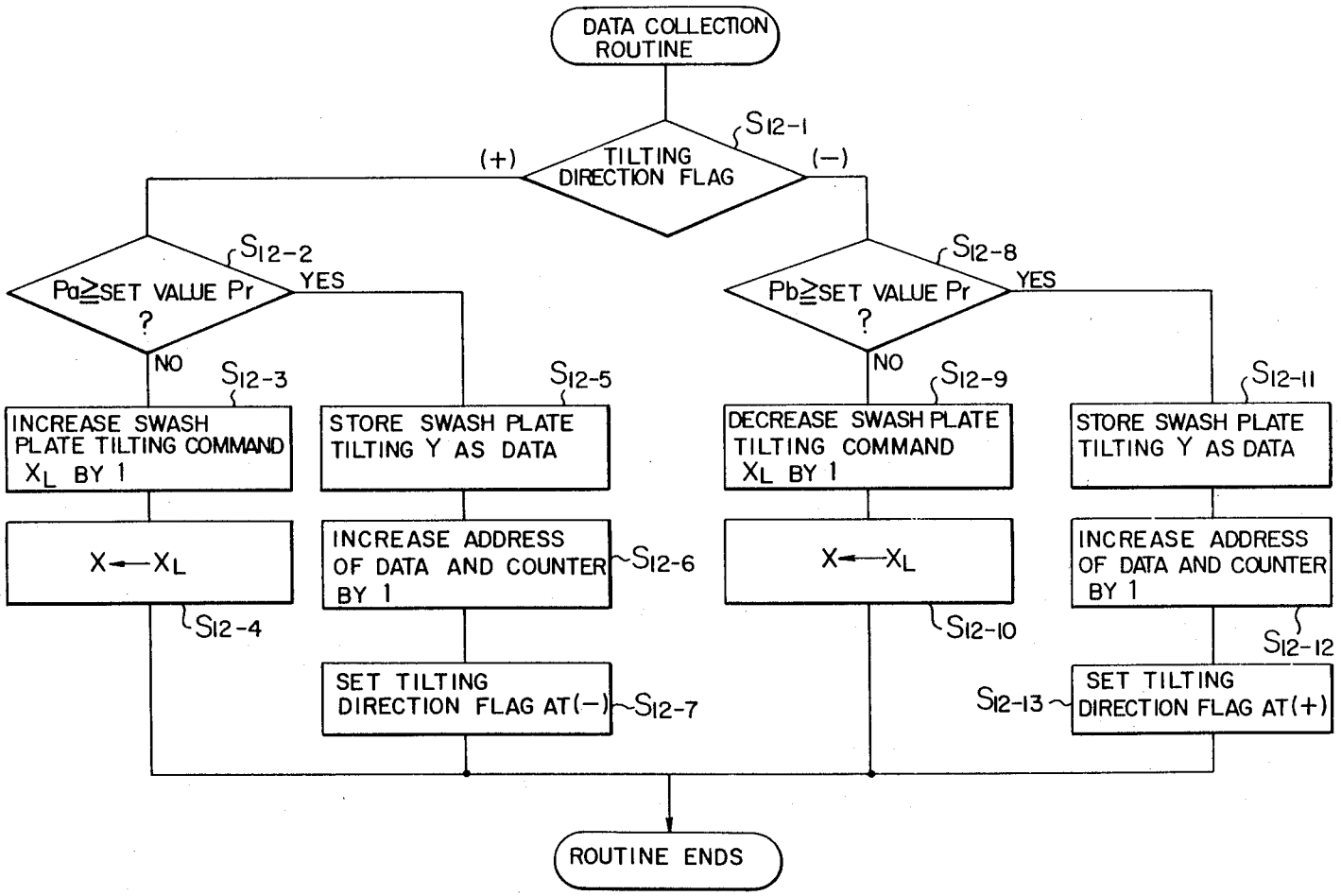

FIG. 8 shows in detail the processes performed in step $S_{12}$. First of all, in step $S_{12-1}$, it is determined whether the tilting direction flag set in step $S_{10-2}$ or $S_{10-3}$ is (+) or (−). If the tilting direction flag is found to be (+), then it is determined whether or not the pressure Pa sensed by the pressure sensor 8*a* is higher than the pressure $P_r$ set beforehand ($S_{12-2}$). If the pressure signal Pa is lower than the pressure $P_r$ set beforehand ($S_{12-2}$), then the swash plate tilting command $X_L$ is added with 1 ($S_{12-3}$). The 1 added is a value corresponding to a predetermined tilting unit angle of the swash plate 1*a*. Assume that the tilting unit angle is set at 0.5 degree, for example, then the swash plate 1*a* would be moved through 0.5 degree each time the swash plate tilting command $X_L$ is added with 1 in the swash plate tilting servo routine. That is, the swash plate 1*a* would have its tilting angle increased by 0.5 degree until the pressure $P_r$ set beforehand is produced. Then, a new swash plate tilting command $X_L$ increased in step $S_{12-3}$ is substituted for the lever command value X ($S_{12-4}$), and the process shifts to step $S_5$ in which the swash plate 1*a* is moved from the position which it has occupied until it taken a new position after being driven in the (+) direction through a tilting angle corresponding to the value 1. The processes are performed again through steps $S_1$, $S_2$, $S_6$, $S_7$, $S_9$, $S_{11}$, $S_{12-1}$ and $S_{12-2}$. If it is determined in step $S_{12-2}$ that the pressure $P_r$ set beforehand is not reached yet, then the swash plate tilting command $X_L$ is further added with a value 1 ($S_{12-3}$), so that the swash plate 1*a* is further driven in the (+) direction through a tilting angle corresponding to the value 1. These processes are repeatedly performed until the pressure Pa sensed by the pressure sensor 9*a* becomes higher than the pressure $P_r$ set beforehand. When the pressure Pa becomes higher than the pressure $P_r$, the process shifts to step $S_{12-5}$ and the swash plate tilting value Y detected by the shifting detector 4 at that time is stored in a predetermined address in the RAM 9*e*. Then, the predetermined address in the RAM 9*e* is increased by 1 and the number of the sampling counter is also increased by 1 ($S_{12-6}$) while setting a tilting direction flag at (−). Although it is not essential to increase address by one or to use an adjacent address, producing of a mean of the values detected would be facilitated if address is increased by one. The increase of the number of sampling counter by one means that one set of data is stored and is used for determination in step $S_{11}$. By setting the tilting direction flag at (−), a preparation is done for tilting the swash plate 1*a* in the (−) direction in the next following process. When the process of step $S_{12-7}$ is finished, the process is returned to step $S_1$ through step $S_5$. In the next cycle of operation, the process shifts from step $S_{12-1}$ because the tilting direction flag is set at (−). In step $S_{12-8}$, the pressure signal Pb produced by the pressure sensor 8*b* is compared with the pressure $P_r$ set beforehand. In this case, the pressure signal Pb is lower than the pressure $P_r$ set beforehand because the swash plate 1*a* is tilting in the (+) direction. Therefore, in the next step $S_{12-9}$, the swash plate tilting command $X_L$ is reduced by 1, and the reduced swash plate tilting command $X_L$ is substituted for the lever command value X. Thus, in step $S_5$, the swash plate 1*a* is moved in the (−) direction through a tilting angle corresponding to the value 1. As is the case with the operation performed when the tilting direction flag is set at (+), the operation is performed until the pressure signal Pb becomes higher than the pressure $P_r$ set beforehand. When the pressure signal Pb becomes higher than the pressure $P_r$ set beforehand, the process shifts to step $S_{12-11}$, and the signal Y produced by the shifting detector 4 at that time or the swash plate tilting value Y is stored in the address next to the predetermined address in the RAM 9*e* described hereinabove, and the next address is set and the number of the sampling counter is increased by 1 ($S_{12-12}$). In the next following operation, since the swash plate 1*a* is to be moved in the (+) direction, the tilting direction flag is set at (+)($S_{12-13}$). Thus, the swash plate 1*a* is caused to tilt a predetermined unit amount both in the (+) direction and in the (−) direction, and the swash plate tilting values Y are stored each time when the pressure $P_r$ set beforehand is produced. This operation is repeatedly performed for a predetermined number of times to thereby collect data.

Figure 9:
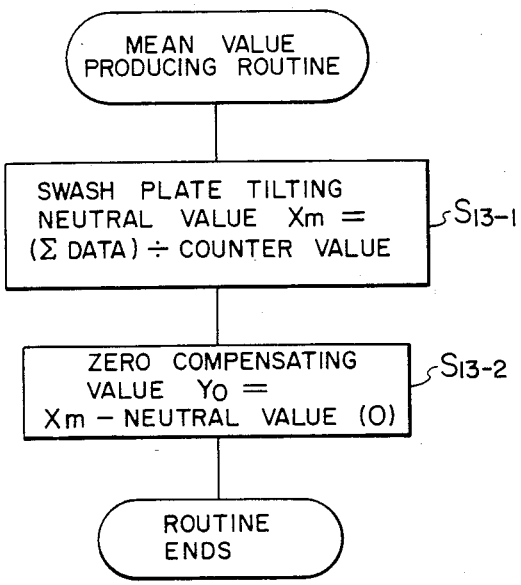

When the data collection is finished, it is determined in step $S_{11}$ that the number counted by the sampling counter is equal to the number set beforehand, so that the process shifts to step $S_{13}$ which is a mean value producing routine for producing a mean of the values collected as data by the processes performed as shown in detail in FIG. 9. In the mean value producing routine, all the values collected as data are retrieved from the addresses in the RAM 9*e* and added together to produce a total which is divided by the number of times the data collection was performed (the values obtained by the sampling counter) in step $S_{13-1}$. A value $X_m$ obtained is a mean of the values obtained by adding together the values of the signal Y produced when the same pressure is produced in the (+) direction and in the (−) direction in which the swash plate 1*a* shifts and by dividing the values by the number of the signal Y produced. Stated differently, the value $X_m$ is a value of the signal Y representing a position of the swash plate 1*a* intermediate between the tilting positions of the swash plate in the (+) direction and in the (−) direction in which the pressures produced shown the same value. Such position of the swash plate 1*a* corresponds to the neutral position of the swash plate 1*a*. Thus, the value $X_m$ is the value of the signal Y when the swash plate 1*a* is actually in the neutral position. It will be apparent that for a mean of the values described hereinabove to be obtained, data collection should be performed for the same number of times in the (+) and (−) directions, and the value of the sampling counter (the value set in step $S_{11}$) is an even number. By increasing the value set in step $S_{11}$, it is possible to increase the accuracy of the value $X_m$. Then, a zero compensating value $Y_o$ is obtained based on the swash plate tilting neutral value $X_m$. The zero compensating value $Y_o$ represents a difference between the value of the signal Y when the swash plate 1*a* is actually in the neutral position and the value (neutral value) of the signal Y when the swash plate 1*a* is considered to be in the neutral position. To obtain the zero compensating value $Y_o$, an arithmetic operation is performed in which the neutral value is deducted from the swash plate tilting neutral value $X_m$ ($S_{13\text{-}2}$). When the neutral value is zero, the zero compensating value $Y_o$ becomes the swash plate tilting neutral value $X_m$ itself. When this arithmetic operation is finished, the process shifts to step $S_5$ in which the zero compensating value $Y_o$ obtained in step $S_{13\text{-}2}$ is stored in a predetermined address in the RAM 9*e*. The zero compensating value $Y_o$ stored in this way is retrieved for use in performing processes in step $S_3$ in the control operation to be performed later. When the start switch 10 is opened, shifting of the process from step $S_2$ to step $S_6$ is blocked and the automatic neutral point detecting operation comes to an end, allowing normal control operations to be performed.

As described hereinabove, the embodiment shown and described hereinabove comprises means for causing the swash plate to tilt alternately in the (+) direction and in the (−) direction for a plurality of number of times and storing the values of signal produced by the shifting detector when pressures produced exceed a pressure of a predetermined value, and means for producing a mean of these values. By virtue of these features, it is possible to automatically detect the actual neutral point of the swash plate without requiring any manual operation, thereby enabling control of the hydraulic pump to be accurately performed.

Figure 10:
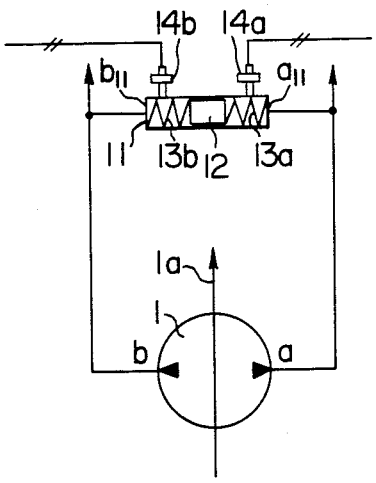
FIG. 10 is a shematic view of the hydraulic circuit and the electric circuit representing a part of the automatic neutral point detecting system for a hydraulic pump comprising another embodiment of the invention.

FIG. 10 shows in a schematic view the hydraulic circuit and the electric circuit of the automatic neutral point detecting system comprising another embodiment of the invention.

The embodiment shown in FIG. 10 is distinct from the embodiment shown in FIG. 4 in that the pressure sensors 8*a* and 8*b* for continuously sensing pressures are replaced by other means for sensing pressures, and the two embodiments are similar to each other in other respects, so that description and showing of the parts shared by the two embodiments shall be omitted. A cylinder 11 is formed at opposite ends thereof with ports $a_{11}$ and $b_{11}$ communicating with the ports a and b of the hydraulic pump 1, respectively. The cylinder 11 has fitted therein a piston 12 for sliding movement in opposite directions. Springs 13*a* and 13*b* are mounted between the piston 12 and opposite ends of the cylinder 11, respectively, and equal to each other in biasing force. 14*a* and 14*b* are contact switches which are rendered operative when the piston 12 moves. When the swash plate 1*a* is driven, pressure is applied to the port $a_{11}$ or $b_{11}$ and causes the piston 12 to move in sliding movement against the biasing force of the spring 13*a* or 13*b*. When the distance covered by the movement of the piston 12 reaches a predetermined value, the contact switch 14*a* or 14*b* is closed. By adjusting the biasing forces of the springs 13*a* and 13*b* in such a manner that the contact switch 14*a* or 14*b* is closed when the pressure $P_r$ set beforehand as described by referring to the embodiment shown in FIGS. 1–9 is applied to the port $a_{11}$ or $b_{11}$, it is possible to let automatic detection of the neutral point of the swash plate 1*a* to be effected in the same manner as described hereinabove by referring to the embodiment shown in FIG. 4. More specifically, ON and OFF conditions of the contact switches 14*a* and 14*b* are inputted to the input unit 9*a* of the control unit 9. If this operation is performed, then one only has to determine whether the contact switches 14*a* and 14*b* are ON or OFF in step $S_{10\text{-}1}$ of the initial setting routine and in step $S_{12\text{-}2}$ and step $S_{12\text{-}8}$ of the data collection routine when the control unit 9 performs control operations, and there is no need to alter other processes performed in effecting automatic neutral point detection.

In place of using the cylinder 11, piston 12, springs 13*a* and 13*b* and contact switches 14*a* and 14*b*, pressure switches may be used which would be mounted on the side of the port a and on the side of port b respectively of the hydraulic pump 1. In this modification, the pressure switches would be activated by pressures which are set beforehand and ON and OFF conditions of the pressure switches would be inputted to the input unit of the control unit. When the modification of the embodiment is used, the same effects as achieved by the embodiment shown in FIG. 10 could be achieved.

Figure 11:
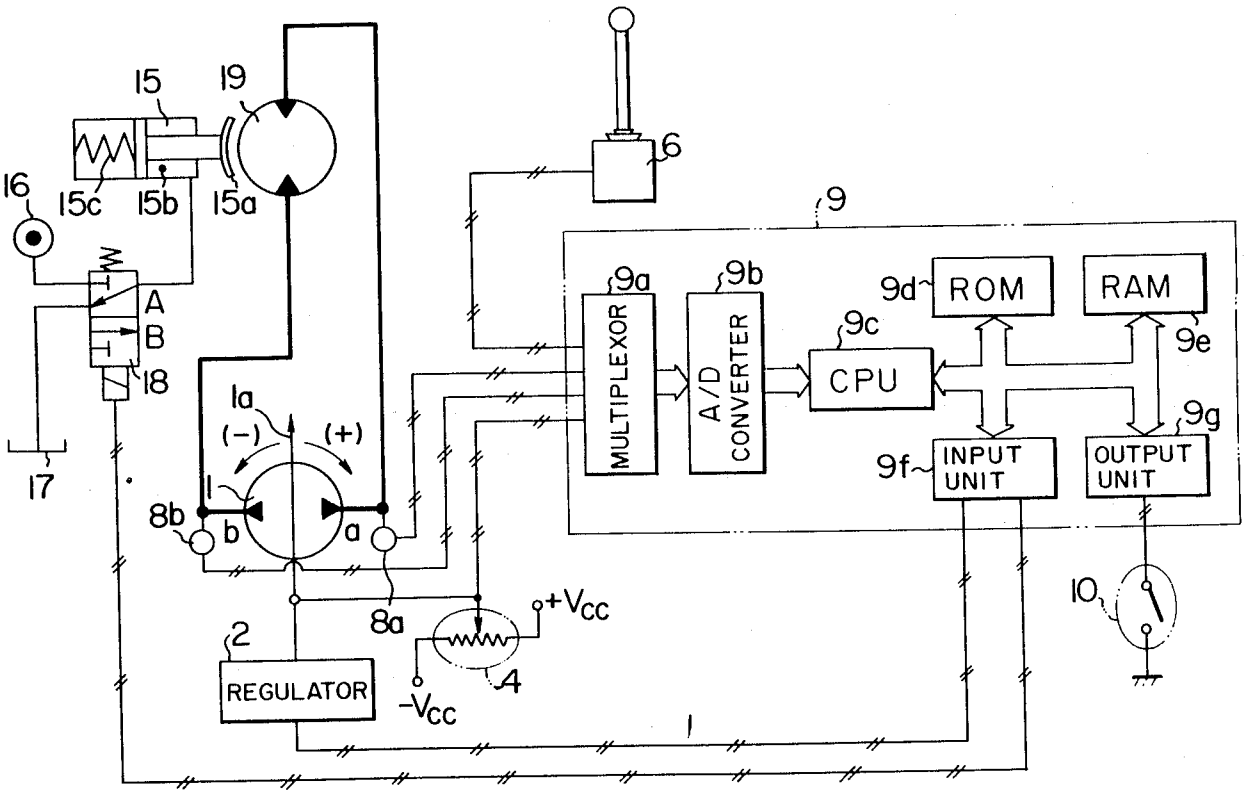
FIG. 11 is a block diagram of the automatic neutral point detecting system for a hydraulic pump comprising still another embodiment of the invention.

FIG. 11 is a block diagram of the automatic neutral point detecting system comprising still another embodiment.

The embodiment shown in FIG. 11 is distinct from the embodiment shown in FIG. 4 in that the ON-OFF control valve 3 of the former is replaced by other means for closing the hydraulic circuit to block the flow of a hydraulic fluid.

In the hydraulic circuit in which the hydraulic pump 1 is mounted, a hydraulic motor 19 for activating a traveling member, for example, is connected as a hydraulic actuator driven by the pump 1. The hydraulic motor 19 is equipped with a brake system 15 comprising a brake shoe 15*a*, a cylinder chamber 15*b* and a spring 15*c*. As hydraulic fluid is supplied from a hydraulic fluid source 16 to the cylinder chamber 15*a*, the spring 15*c* is contracted and the brake shoe 15*a* is released from contact with the hydraulic motor 19. When the cylinder chamber 15*b* is brought into communication with a reservoir 17, the spring 15*c* is expanded and the brake shoe 15*a* is brought into contact with the hydraulic motor 19 to thereby apply the brake. A directional control valve 18 is used for switching the cylinder chamber 15*b* from the hydraulic fluid source 16 to the reservoir 17 and vice versa for connection. The directional control valve 18 is activated by an electric signal. When the electric signal is OFF, the valve 18 takes a position A to allow the cylinder chamber 15*b* to communicate with the reservoir 17 to activate the brake system. When the electric signal is ON, the valve 18 is moved to take a position B to bring the cylinder chamber 15*b* into communication with the hydraulic fluid source 16 to thereby deactivate the brake system 15.

The brake system 15 constitutes means for closing the hydraulic circuit to block the flow of a hydraulic fluid therethrough. In this case, the control unit 9 may be modified by incorporating an amendment in the flow charts of FIGS. 5–9 showing the processes stored in the ROM 9*d* such that the control unit 9 controls the operation of the brake system 15 in step $S_4$ in which normal control processes are performed and turns off the control valve 18 to activate the brake system 15 in step $S_6$ in which automatic neutral point detecting processes are followed. There is no need to alter the other processes performed by the control unit 9.

In the embodiments shown and described hereinabove, the start switch for giving a command to start automatic neutral point detection may, of course, be manually operated. However, the invention is not limited to this specific form of the start switch and the start switch may be actuated automatically in conjunction with the other operation. For example, the start switch may be constructed such that it is closed when the prime mover for driving the hydraulic pump is started and opened after lapse of a predetermined period of time. Also, the start switch may be constructed such that it gives a command to start automatic neutral point detection when it is opened, not when it is closed. In the embodiments shown and described hereinabove, the swash plate has been described as being driven for shifting movement in both directions for a plurality of reciprocatory movements. However, it is not essentially necessary to move the swash plate several times and the number of times the swash plate is moved may be only one in each direction to accomplish the object.

From the foregoing, it will be appreciated that the automatic neutral point detecting system according to the invention for a hydraulic pump is equipped with control means including means responsive to a command given by start means for giving a command to activate closing means for close a hydraulic circuit to block the flow of a hydraulic fluid therethrough, data collecting means for causing displacement varying means of the hydraulic pump to shift at least once in a (+) direction and in a (−) direction until the port pressure on the discharge side of the hydraulic pump sensed by pressure sensing means becomes at least substantially equal to the same predetermined pressure set beforehand for each shifting direction and collecting data on the values of the shifting of the displacement varying means obtained when the port pressure becomes substantially equal to the predetermined pressure, and means for obtaining a mean of the values collected by the data collecting means. Thus, the invention enables the automatic neutral point detection for the hydraulic pump to be effected without relying on manual operations, thereby enabling control of the hydraulic pump to be accurately effected.

What is claimed is:

1. An automatic neutral point detecting system for a hydraulic pump equipped with displacement varying means capable of shifting both in a (+) direction and in a (−) direction and connected to at least one hydraulic actuator to form a hydraulic circuit for driving the hydraulic actuator, comprising:

(a) means for sensing the port pressures of the hydraulic pump;

(b) means for detecting the shifting of the displacement varying means;

(c) means for closing the hydraulic circuit to block the flow of a hydraulic fluid therethrough;

(d) start means for giving a command to start detection of the neutral point of the hydraulic pump; and (e) control means for performing detection of the neutral point of the hydraulic pump;

(f) said control means including:

(i) means responsive to the command given by said start means for giving a command to activate said closing means;

(ii) data collecting means for causing the displacement varying means to shift at least once in the (+) direction and in the (−) direction based on information from said pressure sensing means and said shifting detecting means until the port pressure of the hydraulic pump on the discharge side thereof sensed by said pressure sensing means becomes at least substantially equal to the same predetermined pressure set beforehand for each shifting direction, and collecting data on the values of the shifting of the displacement varying means obtained when the port pressure on the discharge side of the hydraulic pump becomes substantially equal to the predetermined value; and (iii) means for obtaining a mean of the values collected by said data collecting means.

2. An automatic neutral point detecting system as claimed in claim 1, wherein said data collecting means includes means for determining whether or not the port pressure of the hydraulic pump on the discharge side thereof is higher than the predetermined pressure set beforehand, means for causing the displacement varying means to shift by a predetermined unit amount when the port pressure is not higher than the predetermined pressure, and means for reading the shifting of the displacement varying means when the port pressure is substantially equal to the predetermined pressure.

3. An automatic neutral point detecting system as claimed in claim 1, wherein said control means further includes (iv) means responsive to the command given by the start means for causing the displacement varying means to shift to an instantaneous neutral position before said data collecting means and said mean value producing means start their operations.

4. An automatic neutral point detecting system as claimed in claim 1, wherein said control means further includes (v) initial setting means for deciding, based on information from said pressure sensing means, the direction in which the displacement varying means first shifts in accordance with the operation of said data collecting means before said data collecting means and said mean value producing means start their operations.

5. An automatic neutral point detecting system as claimed in claim 4, wherein said initial setting means includes means for determining whether or not one of the port pressure of the hydraulic pump is higher than the predetermined pressure when the displacement varying means is in the instantaneous neutral position, and means for bringing the direction in which the displacement varying means first shifts into agreement with a direction in which said one port pressure rises when the one port pressure is not higher than the predetermined pressure and bringing the direction in which the displacement varying means first shifts into agreement with a direction in which the one port pressure drops when the one port pressure is higher than the predetermined pressure.

6. An automatic neutral point detecting system as claimed in claim 4, wherein said data collecting means includes means for reversing the direction in which the displacement varying means shifts after the displacement varying means first shifts in the direction as decided by the initial setting means and data on the shifting thereof in said direction has been collected.

7. An automatic neutral point detecting system as claimed in claim 1, wherein said closing means includes an on-off control valve connected to the hydraulic circuit in a position between the hydraulic pump and the hydraulic actuator.

8. An automatic neutral point detecting system as claimed in claim 1, wherein said closing means includes a brake system operative to hold said hydraulic actuator in an inoperative condition.

9. An automatic neutral point detecting system as claimed in claim 1, wherein said pressure sensing means includes a pair of pressure sensors operative to continuously measure the port pressures of the hydraulic pump, said pair of pressure sensors being connected to a pair of main lines of the hydraulic circuit, respectively.

10. An automatic neutral point detecting system as claimed in claim 1, wherein said pressure sensing means includes a cylinder connected between a pair of main lines of the hydraulic circuit, a piston fitted in the cylinder for sliding movement, and a pair of contact switches arranged on the cylinder and rendered operative as the piston moves in the cylinder.

* * * * *